United States Patent [19]

de Nora et al.

[11] Patent Number: 4,615,775

[45] Date of Patent: Oct. 7, 1986

[54] ELECTROLYSIS CELL AND METHOD OF GENERATING HALOGEN

[76] Inventors: Oronzio de Nora, Piazza della Repubblica 19; Antonio Nidola, Via Farneti 5; Gian N. Martelli, Via Padova 194, all of Milan, Italy

[21] Appl. No.: 490,515

[22] Filed: May 2, 1983

Related U.S. Application Data

[60] Continuation-in-part of Ser. No. 382,691, May 27, 1982, Pat. No. 4,468,311, and Ser. No. 268,431, May 29, 1981, Pat. No. 4,381,979, which is a continuation-in-part of Ser. No. 212,172, Dec. 2, 1980, which is a continuation-in-part of Ser. No. 102,629, Dec. 11, 1979, Pat. No. 4,340,452, said Ser. No. 382,691, is a division of Ser. No. 102,629.

[51] Int. Cl.[4] ..... C25B 1/26

[52] U.S. Cl. ..... 204/128; 204/98; 204/252; 204/263

[58] Field of Search ..... 204/128, 252, 263–266, 204/283, 98

[56] References Cited

U.S. PATENT DOCUMENTS

| | | | |
|---|---|---|---|
| 3,344,053 | 9/1967 | Neipert et al. | 204/283 |
| 4,105,514 | 8/1978 | Justice et al. | 204/98 |
| 4,340,452 | 7/1982 | de Nora | 204/98 |
| 4,377,455 | 3/1983 | Kadija et al. | 204/98 |
| 4,381,979 | 5/1983 | de Nora | 204/98 |
| 4,402,814 | 9/1983 | Rechlicz | 204/283 |

FOREIGN PATENT DOCUMENTS

| | | |
|---|---|---|
| 0050373 | 4/1982 | European Pat. Off. . |
| 2051870 | 1/1981 | United Kingdom . |

OTHER PUBLICATIONS

Patent Abstracts of Japan, vol. 7, No. 195 (C-183) (1340), Aug. 25, 1983, JP-A-5896886 (Asahi Glass K.K.) Jun. 9, 1983.

Chemical Abstracts, vol. 99, Jul. 1983, No. 2, p. 448, No. 12849r, JP 58 37,181.

*Primary Examiner*—John F. Niebling

*Assistant Examiner*—Terryence Chapman

*Attorney, Agent, or Firm*—Pollock, Vande Sande & Priddy

[57] ABSTRACT

Halogen is produced by electrolyzing an aqueous halide in a specially designed cell. The cell comprises an anolyte chamber and a catholyte chamber separated by a permeable membrane or diaphragm, notably an ion exchange (generally cation exchange) polymer. At least one electrode comprises at least two sections. One section comprises a gas and electrolyte permeable layer, sheet or mat having a catalytic surface, i.e. one having a low overvoltage, (low hydrogen overvoltage if the cathode and low halogen overvoltage if the anode). This layer is spaced from the membrane by a second portion comprising an electroconductive resiliently compressible layer or mat, which is in contact with the membrane on one side thereof, the other side thereof being in contact with the main cathode.

This second or spacer section advantageously has an electrode surface having a higher overvoltage than the first electrode surface. Preferably the cathode has the above construction.

Upon electrolysis of alkali metal chloride or other halide in such a cell and with a cathode of the type described above, a low voltage is obtained even at high current densities and the cathode efficiency is high.

20 Claims, 2 Drawing Figures

ELECTROLYSIS CELL AND METHOD OF GENERATING HALOGEN

CROSS-REFERENCE TO RELATED APPLICATIONS

This application is a continuation in part of copending U.S. application Ser. No. 268,431, filed May 29, 1981 and entitled "Electrolysis Cell and Method of Generating Halogen" now U.S. Pat. No. 4,381,979, which in turn is a continuation in part of copending U.S. application Ser. No. 212,172, filed Dec. 2, 1980 2nd still pending entitled "Electrolysis Cell and Method of Generating Halogen" which in turn is a contination in part of U.S. patent application Ser. No. 102,629, filed Dec. 11, 1979 entitled "Novel Electrolysis Cell and Method of Electrolyzing Halides" and now U.S. Pat. No. 4,340,452, and is a continuation in part of copending U.S. application Ser. No. 382,691 filed May 27, 1982 entitled "Novel Electrolysis Cell and Method of Electrolyzing Halides" now U.S. Pat. No. 4,468,311, which in turn is a division of said U.S. application Ser. No. 102,629 now U.S. Pat. No. 4,343,690.

DESCRIPTION

Background Art

It is known to electrolyze aqueous alkali metal chloride or like halide in a membrane cell having an ion exchange (normally cation exchange) membrane which separates anode from cathode. Since the membrane itself is generally impermeable or substantially so to gas and liquid flow, the electrolysis generates chlorine at the anode and alkali at the cathode, the alkali being of high purity and containing only very low chloride concentration.

One type of cell which has been proposed for such electrolysis is the solid polymer electrolyte cell.

A solid polymer electrolyte cell is characterized by an ion exchange membrane, which separates electrode of the cell and by the fact that one or preferably both electrodes are in contact with the membrane. The solid polymer electrolyte cells present (with respect to conventional membrane cells in which the cathode and frequently both anode and cathode are separated from the membrane), several advantages useful in different electrolysis processes. More precisely:

(1) The overall voltage between electrodes is lower because the interelectrodic distance is reduced practically to the membrane thickness.

(2) The so-called "bubble effect" is eliminated or at least minjmized, i.e. the difficulty normally encountered in electrolytic processes where gas is evolved at the electrode accumulates in the zone between electrodes is avoided because evolved gas can be released behind the electrodes to the inside of the cell compartment.

(3) The cell may be very compact and thus the ohmic drops at the current distribution structures can be reduced.

The ion permeable diaphragms are cation exchange polymers in the form of thin flexible sheets or membranes. Generally they are imperforate and do not permit a flow of anolyte into the cathode chamber but it has also been suggested that such membranes may be provided with some small perforations to permit a small flow of anolyte therethrough, although the bulk of the work appears to have been accomplished with imperforate membranes.

Typical polymers which may be used for this purpose include fluorocarbon polymers such as polymers of trifluoroethylene or tetrafluoroethylene or copolymers thereof which contain ion exchange groups are used for this purpose. The ion exchange groups normally are cationic groups including sulfonic acid, sulfonamide, carboxylic acid, phosphoric acid and the like, which are attached to the fluorocarbon polymer chain through carbon and which exchange cations. However, they may also contain anion exchange groups. Typical such membranes have the general formula:

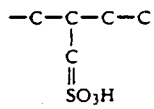

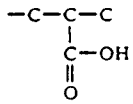

Such membranes include typically those fluorocarbon ion exchange polymers manufactured by the Du Pont Company under the trade name of "Nafion" and by Asahi Glass Company of Japan under the trade name of "Flemion". Patents which describe such membranes include British Pat. No. 1,184,321 and U.S. Pat. Nos. 3,282,875 and 4,075,405.

Since these diaphragm are ion permeable but do not permit anolyte flow therethrough, little or no halide ion migrates through the diaphragms or such a material in an alkali chloride cell and therefore the alkali thus produced contains little or no chloride ion. Furthermore, it is possible to produce a more concentrated alkali metal hydroxide in which the catholyte produced may contain from 15 to 45% NaOH by weight or over higher. Patents which describe such a process include U.S. Pat. Nos. 4,111,779 and 4,100,050 and many others. The application of an ion exchange membrane as an ion permeable diaphragm has been proposed for other uses such as in water electrolysis.

In cells of the type contemplated, the cathode is in close proximity to or in direct contact with the ion exchange membrane. They must be sufficiently permeable to permit rapid escape of evolved gas from the points of their evolution and to provide ready access of liquid electrolyte to these points as well as rapid removal of evolved alkali or other electrolysis produced from such points. Thus the electrodes are normally quite porous.

One difficulty which has been encountered with permeable cathodes which are in direct contact with or bonded to the membrane is that cathodic efficiency is relatively low for example 85% or below and that oxygen in appreciable concentration, for example above 0.5 to 1% or more by volume, is evolved in the chlorine produced.

Apparently some portion of the alkali metal hydroxyl evolved at the cathode tends to migrate through the membrane. This may be due to the fact that caustic soda produced at the interface is not sufficiently and uniformly diluted by the catholyte within the cathode compartment of the cell.

The high alkalinity may induce dehydration of the membrane with consequent decrease of the electrical conductivity, moreover the high concentration gradient increases the back-diffusion of the hydroxyl ions towards the anode with a resulting loss of the faraday efficiency.

The creation of varying gradients of alkalinity on or in the membrane may cause membrane shrinking and membrane swelling in localized areas and continual changing of these events and this may result in detachment and/or loss of cathode layer or cathodic material. Whatever the actual mechanism, the adverse results referred to above accrue.

BEST AND VARIOUS MODES OF CARRYING OUT THE INVENTION

According to this invention halogen is effectively generated by electrolyzing an aqueous halide in an electrolytic cell having a pair of opposed electrodes separated by an ion permeable separator, preferably an ion exchange polymer and where at least one electrode, preferably the cathode, has two layers. The first layer is resistant to chemical and electrochemical attack and has a low overvoltage being readily capable of functioning as an electrode and evolving electrolysis product by electrolysis. The second such layer has a higher overvoltage (hydrogen overvoltage in the case of the cathode surface or chlorine overvoltage in the case of anode surface) and is between the lower overvoltage surface and the membrane, generally being in direct contact with the membrane. Of course both surfaces are electroconductive and are capable of being polarized as an electrode. Furthermore both surfaces are in direct electrical contact so that there is little or substantially no potential difference between them.

Since the first or rear most cathode section has a lower hydrogen overvoltage surface than that of the front section engaging the membrane a major portion and even substantially all of the cathodic electrolysis occurs at points spaced by the spacer or barrier from the membrane as distinguished from on or close to the membrane surface.

The cathode where the major electrolysis takes place is readily porous and permits ready flow including lateral flow of catholyte therethrough. Thus it may be in the form of fine mesh flexible electroconductive metal screen having 3 to 10 mesh openings per centimeter or a mat of undulating wire screen or a combination of these elements. The openings are relatively large and thus provide channels adjacent to the points of contact between the conductive second layer or spacer and the main catalytic catode section whereby catholyte may flow edgewise along the catalytic cathode surface and adjacent these points thereby sweeping away evolved alkali from the front portion of the cathode, as well as from the areas remote from the membrane.

For example, the more active cathode layer may have a surface comprising a platinum group metal or oxide thereof which has a very low hydrogen overvoltage. In that case the intermediate spacer of layer can have an electroconductive surface of a metal or of an oxide which is higher in overvoltage. A porous silver or stainless steel or nickel screen may be used for this purpose. As will be understood other conductive materials which are resitant to corrosion in the alkaline cathode area may also be used. The intermediate section in any case is porous and permeable to electrolyte. Being quite electroconductive, it may cooperate in transmitting current to the more remote active cathode areas without serious increase in overall voltage.

According to the preferred embodiment of the present invention, the intermediate or spacer layer of the multilayered cathode comprises an electroconductive resiliently compressible wire mat which has a surface of higher hydrogen overvoltage than the surface of the main or catalytic cathode layer.

The resiliently compressible wire mat forming the intermediate or spacer layer of the cathode is advantageously compressed, upon assembly of the cell, between the membrane and the active or catalytic layer of the cathode. Therefore the intermediate resilient layer exerts an elastic reaction force against the membrane and the active layer during operation and effectively maintains spaced the surface of the membrane and that of the active cathode. Thus the resiliently compressed wire mat forming the intermediate or spacer layer besides acting to maintain a certain separation between the main active layer of the electrode and the surface of the membrane, also provides for restraining the flexible membrane from fluttering under the action of the gas bubbles induced turbulence of both the anolyte and the catholyte or from bending towards the anode or the cathode under the action of varying hydraulic heads differentials. This is of great importance since it has been found that membranes which were assembled in cells without resilient or other means capable to maintain them firmly in place are often subjected to chafing by continuous rubbing of the membrane against the foraminous metal electrodes.

The rigid mechanical restraints of the compressed mat are provided on one side by the substantially rigid foraminous anode against which the flexible membrane bears and on the other side by a substantially rigid foraminous pressure plate which may itself be the active catalytic layer of the cathode or it may be the current distributor against which the foraminous catalytic layer of the cathode bears.

In the latter case the resiliently compressed mat has two functions; one is to provide and secure a certain separation, preferably from 1 to 4 mm, between the surface of the membrane and the surface of the active cathode layer during operation of the cell, the other is to press the active cathode layer against the rigid current distributing means for a satisfactory operation of the cathode.

Considering that the active cathode layer most advantageously is made of a catholyte resistant metal such as iron, stainless steel, nickel, copper or alloys thereof, coated with a catalytic material having a low hydrogen overvoltage, such as a noble metal (Pt, Rh, Ru, Ir, Pd) or alloy thereof or a conductive oxide thereof or of other metals and that these coatings, which impart low hydrogen overvoltage characteristic to the main cathode layer, are seldom permanent but need to be renewed after a certain period of operation, it is evident that a great advantage derives from the possibility, offered by this preferred embodiment of the invention, to substitute the worn out active cathode layer without having to disconnect or to cut welds and to weld or connect back in place the newly coated cathode.

In fact, in the cell of the present invention, the active cathode layer may be a thin foraminous coated metal screen which is simply sandwiched between the resiliently compressed spacer layer or mat and a substantially rigid pressure plate or a series of spaced ribs or stubs, acting as the current distribution means to the active cathode layer.

The resiliently compressible mat, forming the spacer layer of relatively high hydrogen overvoltage, is pliable and springlike in character and while capable of being compressible to a reduction of up to 60 percent or more of its uncompressed thickness against the membrane by application of pressure from the compression means, it is also capable of springing back substantially to its initial thickness upon release of the clamping pressure. Thus, by its elastic reaction memory, it applies and maintains substantially uniform pressure against the membrane since it is capable of distributing pressure stress and of compensating for irregularities in the surfaces with which it is in contact. It is flexible enough to bend in all directions and to assume the contours of the membrane. The compressible mat should also provide ready circulation of the electrolyte to and from the membrane surface.

Thus, the compressible layer is open in structure and includes a large free volume. The resiliently compressible mat is essentially electrically conductive on its surface, generally being made of a metal resistant to the electrochemical attack of the electrolyte in contact therewith and it thus helps distributing polarity and current over the main active electrode layer.

A preferred embodiment of the resilient spacer layer of the present invention is characterized in that it consists of a substantially open mesh, planar, electroconductive metal-wire article or screen having an open network and is comprised of wire or fabric resistant to the electrolyte and the electrolysis products and in that some or all of the wires form a series of coils, waves or crimps or other undulating contour whose diameter or amplitude is substantially in excess of the wire thickness and preferably corresponds to the article thickness, along at least one direction parallel to the plane of the article. Of course such crimps or wrinkles are disposed in the direction across the thickness of the screen.

These wrinkles in the form of crimps, coils, waves or the like have side portions which are sloped or curved with respect to the axis normal to the thickness of the wrinkled fabric so that, when the layer is compressed, some displacement and pressure is transmitted laterally so as to make distribution of pressure more uniform over the electrode area or surface. Some coils or wire loops which, because of irregularities on the planarity or parallelism of the surface compressing the fabric, may be subjected to a compressive force greater than that acting on adjacent areas, are capable of yielding more to discharge the excess force by transmitting it to the neighboring coils or wire loops. Therefore, the fabric is effective in acting as a pressure equalizer to a substantial extent and in preventing the elastic reaction force acting on a single contact point to exceed the limit whereby the membrane is excessively pinched or pierced. Of course, such self-adjusting capabilities of the resilient layer are also instrumental in obtaining a good and uniform contact distribution over the entire surface of the electrode.

One very effective embodiment desirably consists of a series of helicoidal cylindrical spirals of wire whose coils are mutually wound with the ones of the adjacent spiral in an intermeshed or interlooped relationship. The diameter of the spirals is 5 to 10 or more times the diameter of the wire of the spirals. According to this preferred arrangement, the wire helix itself represents a very small portion of the volume enclosed by the helix and therefore the helix is open on all sides thereby providing an interior channel to permit circulation of the electrolyte.

It is not, however, necessary for the helicoidal cylindrical spirals to be wound in an intermeshed relationship with the adjacent spirals as previous described, and they may also consist of single adjacent metal wire spirals. In this case, the spirals are juxtaposed one beside another with the respective coils being merely engaged in an alternate sequence.

According to a further embodiment, the spacer layer consists of a crimped knitted mesh or fabric of metal wire wherein every single wire forms a series of waves of an amplitude corresponding to the maximum height of the crimping of the knitted mesh or fabric. As an alternative, two or more knitted meshes or fabrics, after being individually crimped by forming may be superimposed one upon another to obtain a layer of the desired thickness.

The crimping of the metal mesh or fabric imparts to the layer a great compressibility and an outstanding resiliency to compression under a load which may be at least about 50–2000 grams per square centimeter ($g/cm^2$) of surface applying the pressure.

The mat is capable of being compressed to a much lower thickness and volume. For example, it may be compressed to about 50 to 90 percent or even lesser percent of its initial volume and/or thickness and is, therefore, pressed or compressed between the membrane and the active cathode layer.

The mat is moveable or slideable with respect to the adjacent surfaces of the membrane and of the active cathode layer between which it is compressed. When clamping pressure is applied, the wire loops or coils constituting the resilient mat may deflect and slide laterally and distribute pressure uniformly over the entire surfaces with which it contacts.

A large portion of the clamping pressure of the cell is elastically memorized by every single coil or wave of the metal wires forming the spacer layer.

Preferably, the resilient mat is compressed to about 80 to 30 percent of its original uncompressed thickness under a compression pressure which is comprised between 50 and 2000 grams per square centimeter of projected area. Even in its compressed state, the resilient mat must be highly porous and the ratio between the voids volume and the apparent volume of the compressed mat expressed in percentage is advantageously at least 75% (rarely below 50%) and preferably is comprised between 85% and 96%.

The diameter of the wire utilized may vary within a wide range depending on the type of forming or texturing being low enough in any event to obtain the desired characteristics of resiliency and deformation at the cell-assembly pressure. An assembly pressure corresponding to a load between 50 and 500 $g/cm^2$ of electrodic surface is normally required to obtain a good electrical contact between the active cathode layer and the cooperating current distribution structures or collectors although higher pressures may be used.

It has been found that by providing a deformation of the resilient spacer layer of the invention of about 1.5 to 3 millimeters (mm) which corresponds to a compression not greater than 60% of the thickness of the non-compressed article, at a pressure of about 400 $g/m^2$ of projected surface a contact pressure at the active cathode layer may be obtained within the above cited limits also in cells with a high surface development and with deviations from planarity up to 2 millimeters per meter (mm/m).

The metal wire diameter is preferably between 0.1 or even less and 0.3 millimeters, while the thickness of the non-compressed article, that is, either the coils' diameter or the amplitude of the crimping is 5 or more times the wire diameter, preferably in the range of 4 to 10 millimeters. Thus it will be apparent that the compressible section encloses a large free volume, i.e. the porportion of occupied volume which is free and open to electrolyte flow and gas flow.

In the wrinkled (which includes these compressing wire helixes) fabrics described above, this percent of free volume is about 75% of the total volume occupied by the fabric and this percent of free volume rarely should be less than 25% and preferably should not be less than 50%. Pressure drop in the flow of gas and electrolyte through such a fabric is negligible.

BRIEF DESCRIPTION OF THE DRAWINGS

The invention herein contemplated may be applied to an electrolytic cell such as the one diagrammatically illustrated in the accompanying drawings in which.

Figure 1:
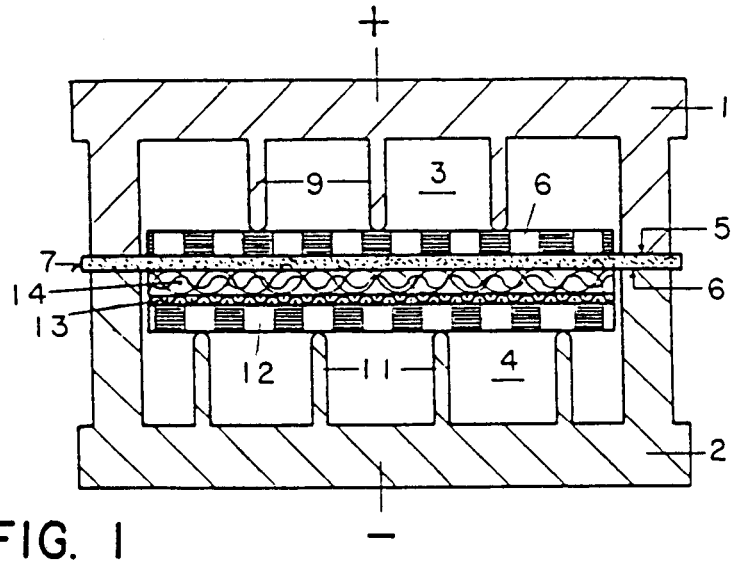
FIG. 1 is a diagrammatic horizontal sectional view of the cell having the double layer electrode installed therein.

As shown, the cell comprises an anode end plate 1 and a cathode end plate 2, both mounted in a vertical plane with each end-plate in the form of a channel having side walls respectively enclosing an anode space 3 and a cathode space 4. Each end plate also has a peripheral seal surface on side-walls projecting on each side of the cell from the plane of the respective end plate, 5 being the anode seal surface and 6, being the cathode seal surface. These surfaces, with the interposition of suitable gaskets, not shown in the drawing, bear against a membrane or diaphragm 7, which stretches across the enclosed space between the side walls separating anode from cathode.

The anode 8 may comprise a relatively rigid uncompressible sheet of expanded titanium metal or other perforate, anodically resistant substrate, preferably having a non-passivatable coating thereon such as a metal or oxide or mixed oxide of a platinum group metal. This sheet is sized to fit within the side walls of the anode back plate and is supported rather rigidly by spaced electroconductive ribs 9 which are fastened to and project from the web or base of the anode end-plate-plate 1. The spaces between the ribs provide for ready flow of anolyte which is fed into the bottom and withdrawn from the top of such spaces. The entire end plate and ribs may be of graphite and alternatively, it may be of titanium clad steel or other suitable material. The rib ends bearing against the anode sheet 8 may or not be coated, e.g. with platinum or like metal to improve electrical contact and the anode sheet 8 may, if desired, be welded to the ribs 9. The anode rigid foraminous sheet 8 is held firmly in an upright position. This sheet may be of expanded metal having upwardly inclining openings 10 directed away from the membrane (see FIG. 2) to deflect rising gas bubbles towards the space 9 and away from the membrane.

On the cathode side, ribs 11 extend outward from the base of the cathode end plate 2 a distance which is a fraction of the entire depth of the cathode space 4. These ribs are spaced across the cell to provide parallel space for vertical electrolyte flow from bottom to top and engage the cathode, which is in sheet or layer form. The cathode end plate and ribs may be made of steel or a nickel iron alloy or other cathodically resistant electroconductive material. On the conductive ribs 11 is welded a relatively rigid pressure plate 12, which is perforate and readily allows circulation of electrolyte from one side thereof to the other. Generally these openings or louvers are inclined upward and away from the membrane or compressible electrode toward the space 4 (see also FIG. 2) The pressure plate is electroconductive and serves to impart cathodic polarity to the electrode and to apply pressure thereto and it may be made of expanded metal or heavy screen of steel, nickel, copper or alloys thereof.

The main or active cathode layer may advantageously be made of a fine flexible screen 13 of a cathodically resistant electroconductive material, such as nickel, stainless steel, iron, copper or alloys thereof, coated with a cathodically resistant catalytic material having a low hydrogen overvoltage. Many catalytic materials for hydrogen evolution in caustic solutions are known in the art, particularly suitable materials are the noble metals such as platinum, ruthenium, palladium, rhodium, iridium and osmium, their alloys and oxides, Raney nickel, molybdenum and tungsten alloys. Any of these materials can be used successfully to coat the cathode screen.

The resiliently compressible spacer layer 14, interposed between membrane 7 and the main active layer 13 may be made of a crimped corrugated or wrinkled compressible wire-mesh fabric which fabric is advantageously an open mesh knitted-wire mesh of the type described in U.S. Pat. No. 4,343,690, wherein the wire strands are knitted into a relatively flat fabric with interlocking loops. This fabric is then crimped or wrinkled into a wave or undulating form with the waves being close together, for example 0.3 to 2 centimeters apart, and the overall thickness of the compressible fabric is 2 to 10 millimeters. The crimps may be in a zig-zag or herringbone pattern and the mesh of the fabric is coarser, i.e. has a larger pore size than that of screen 13.

In this preferred embodiment the resiliently compressible space layer 14 is instrumental in providing for a good electrical contact between the pressure plate 12 and the main or active cathode layer 13, which is pressed by the spacer layer 14 against the current distributor pressure plate 12 uniformly over the entire electrode surface.

The resiliently compressible spacer layer 14, also presses the maintains the flexible membrane 7 bearing against the rigid foraminous anode 8, thus preventing its movement and fluttering in the cell.

The layer 14 effectively spaces the surface of the main or active cathode layer from the membrane of an easily predetermined distance which preferably may be comprised between 1 and 4 mm.

Since the spacer layer 14 has a higher hydrogen overvoltage than the active layer 13, the electrode reactions take place substantially at the surface of the catalytic screen 13 and because of the very open structure of the compressed layer 14 of fine metal wire.

The products of the electrode reaction are easily diluted and quickly removed from the surface of the membrane, thus effectively preventing high concentration gradients across the surface of the membrane.

In the operation of this embodiment, substantially saturated sodium chloride aqueous solution is fed into the bottom of the anolyte compartment of the cell and flows upward through channels or spaces 3 between ribs 9 and depleted brine and evolved chlorine escapes from the top of the cell. Water or dilute sodium hydroxide is fed into the bottom of the cathode chamber and rises through channels 4 as well as through the voids of the compressed spacer layer 14 and evolved hydrogen and alkali is withdrawn from the top of the cell.

Electrolysis is caused by imparting a direct current electric potential between the anode and cathode end plates.

Figure 2:
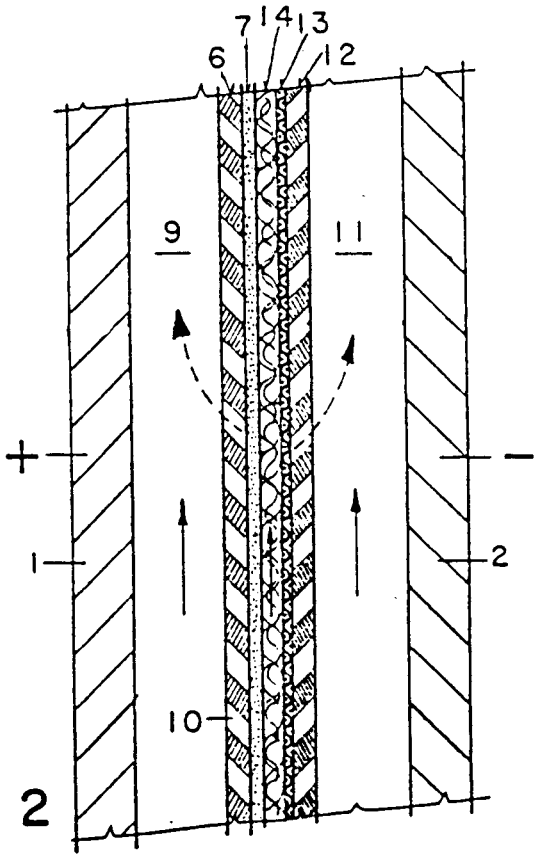
FIG. 2 is a diagrammatic vertical sectional view of the cell of FIG. 1.

As shown in FIG. 2, the openings in pressure plate 12 are louvered to provide an inclined outlet directed upwardly away from the compressed fabric layer 14, whereby some portion of evolved hydrogen and/or electrolyte escapes to the rear electrolyte chamber 4. Therefore, the vertical spaces at the back of the pressure plate 12 and the space occupied by the compressed fabric 14 are provided for upward catholyte and gas flow.

According to the improved method of this invention for the electrolysis of sodium chloride, aqueous brine containing from 140 to 300 grams per liter of sodium chloride is circulated within the anode compartment of the cell. Chlorine is evolved at the anode, while the solvated ions tend to migrate through the cation membrane and reach the cathode where caustic soda of substantial concentration above 15–20% by weight and hydrogen is evolved. Solutions containing 25 to 40% by weight of alkali metal hydroxide may be produced with anode and cathode efficiencies above 90%, frequently above 94%.

The following examples are illustrative:

EXAMPLE

A laboratory size electrolytic cell was manufactured having an effective electrode area 100 millimeters (mm) high and 100 millimeters (mm) wide.

The cell frames and back plates were made of titanium for the anodic portion and of stainless steel (AISI 316) for the cathodic portion.

The anode was an expanded titanium sheet 1.5 mm thick, coated with a non passivatable catalytic coating of a mixture of oxides of Ruthenium and Titanium in the respective weight ratio of 1 to 1, as referred to the metals, obtained by thermal decomposition of a solution of the salts of the metals.

The depth of the anode chamber behind the anode was 12 millimeters (mm).

The membrane was a laminated sheet having a thickness of about 0.25 mm, comprising two layers of cation exchange resin laminated together with an interlayer of a polytetrafluoroethylene screen, as mechanical support. The two layers are made of a copolymer of tetrafluoroethylene and a perfluorovinylether, one containing sulphonic groups and the other containing carboxylic groups.

The membrane was assembled in the cell with its carboxylic layer facing the catholyte compartment.

The cathode structure comprised:

(a) a current collector in the form of a perforated sheet of AISI 316, 2.0 millimeters thick, provided with holes of diameter 3.0 mm, with a pitch of 5 mm, welded on AISI 316 vertical ribs. The depth of the cathode chamber behind the current collector screen was 18 millimeters.

(b) a main or catalytic cathode layer in the form of a 25 mesh nickel screen coated with a 7 to 8 gram per square meter loading of an alloy of ruthenium (80 to 85 percent) and nickel (15 to 20 percent), providing for an exceptionally low hydrogen overvoltage.

(c) a resiliently compressed spacer layer in the form of a mat made of three double layers of loosely knitted nickel wire of a diameter of 0.11 millimeters.

The catalytic cathode layer (b) was interposed between the rigid current collector (a) and the resilient spacer layer (c) and, upon the clamping together of the cell, the current collector was compressing the resilient mat against the surface of the membrane, which membrane was bearing in turn against the rigid anode. The compression corresponding to a pressure of about 400 grams per square centimeter was reducing the thickness of the resilient mat, interposed between the active cathode screen and the membrane, from its original uncompressed thickness of about 6 mm down to about 2.7 millimeters. Therefore, the distance between the surface of the anode and the surface of the active cathode layer was about 2.7 millimeters plus the thickness of the membrane, that is practically it was comprised between 2.7 and 2.8 millimeters.

The cell operated at the following conditions:

Current density: 300 $A/m^2$
Anolyte concentration: 175 g/l of NaCl
Catholyte concentration: 30% by wt. of NaOH
Temperature: 90° C.±1° C.
Cell voltage: 3.12 V±0.02
Cathodic current efficiency: 94.5%
Oxygen in chlorine gas: 0.1% by volume.

REFERENCE EXAMPLE

The same cell described in Example 1 was disassembled and the main (or catalytic) cathode screen of coated nickel (b) was placed against the surface of the membrane, the resilient mat of knitted nickel wire (c) was placed between the rigid current collector (a) and the active cathode screen.

Upon re-assembly of the cell, the resilient mat was compressed down to a thickness of about 2.7 mm, thereby pressing the active cathode screen against the surface of the membrane. Therefore, the distance between the surface of the anode and the surface of the cathode corresponded to the thickness of the membrane, that is about 0.25 millimeters.

The cell was operated at exactly the same conditions as indicated in the previous example and the results were as follows:

Cell voltage: 3.19 V±0.02
Cathodic current efficiency: 93%
Oxygen is chlorine gas: 0.5% by volume The method of the invention may be practiced with any type of ion permeable membrane.

The membrane may be of the monolayer type or it may be a laminated membrane comprising different layers made of different ion exchange resins and the membrane may also include reinforcing fibers or fabrics.

The surfaces of the membrane may be modified either in their chemical composition or in their physical morphology, for example the membrane may have a roughened surface.

Also the membrane may have a porous layer of resin or of particulate material forming a microporous layer over the surface of the membrane, said layer being either conductive or non conductive in character.

As it will be obvious to the expert, the current distribution means which in the preferred embodiment described in the accompanying drawings are depicted in the form which comprises a substantially rigid foraminous plate 12, may be of different nature, for example the active cathode screen 13 may be pressed by the resilient wire mat directly against the vertical ribs 11, extending from the cathode end plate.

Preferably in the latter case the active cathode screen 13 can be made of a heavier gauge screen and the distribution of the vertical ribs may be made more dense, that is with a larger number of ribs per unit of width of the cell compartment, in order to provide sufficient number of electric contact between the active screen and the current distribution means.

What I claim is:

1. A method of generating chlorine which comprises electrolyzing an aqueous alkali metal chloride in a cell having an ion permeable membrane dividing the cell into an anode compartment, an anode in said anode compartment, and a cathode compartment, a cathode in the cathode compartment, said cathode comprising a screen having a low hydrogen overvoltage in contact with substantially rigid current distribution means and a high hydrogen overvoltage resiliently compressible wire mat compressed between the membrane and the low hydrogen overvoltage screen to maintain the low hydrogen overvoltage screen spaced from the membrane and wherein the mat presses the low voltage screen against the current distribution means.

2. The method of claim 1 wherein the membrane is compressed by said resiliently compressible wire mat against the surface of the anode.

3. The method of claim 1 wherein said membrane is an ion exchange polymer.

4. The method of claim 1 wherein said screen has 3 to 10 mesh openings per centimeter.

5. The method of claim 1 wherein said wire mat comprises a surface of a material selected from the group of silver, stainless steel, and nickel.

6. The method of claim 1 wherein the separation between the surface of the membrane and the surface of the cathode is 1–4 mm.

7. The method of claim 1 wherein said screen comprises a metal selected from the group of iron, stainless steel, nickel, and copper, and alloys thereof; and being coated with a noble metal, alloy thereof, conductive oxide thereof, Raney nickel, or molybdenum and tungsten alloys.

8. The method of claim 1 wherein said wire mat comprises a series of helicoidal cylindrical spirals of wire whereby the diameter of the spirals is 5 to 10 times the diameter of the wire.

9. An electrolytic diaphgram cell comprising a ion-exchange membrane dividing the cell into an anode compartment and a cathode compartment, a foraminous anode in the anode compartment, a foraminous cathode in the cathode compartment, characterized in that said cathode comprises a screen having a surface of low hydrogen overvoltage spaced from the surface of the membrane by a resiliently compressed wire mat having a surface of higher hydrogen overvoltage than the surface of said screen and said screen being pressed by said resiliently compressed wire mat against current distribution means rigidly mounted in the cathode compartment.

10. The cell of claim 9 wherein the membrane bears directly against the surface of the foraminous anode.

11. The process of claim 1 wherein said mat is capable of springing back substantially to its initial thickness and wherein said mat applies and maintains substantially uniform pressure against the membrane and is sufficiently flexible so as to bend in all directions and to provide ready circulation of the electrolyte to and from the membrane surface.

12. The cell of claim 9 wherein said membrane is an ion exchange polymer.

13. The cell of claim 9 wherein said screen has 3 to 10 mesh openings per centimeter.

14. The cell of claim 9 wherein said wire mat comprises a surface of a material selected from the group of silver, stainless steel, and nickel.

15. The cell of claim 9 wherein the separation between the surface of the membrane and the surface of the cathode is 1–4 mm.

16. The cell of claim 9 wherein said screen comprises a metal selected from the group of iron, stainless steel, nickel, and copper, and alloys thereof; and being coated with a noble metal, alloy thereof, conductive oxide thereof, Raney nickel, or molybdenum and tungsten alloys.

17. The cell of claim 9 wherein said wire mat comprises a series of helicoidal cylindrical spirals of wire whereby the diameter of the spirals is 5 to 10 times the diameter of the wire.

18. The cell of claim 3 wherein said mat is capable of springing back substantially to its initial thickness and wherein said mat applies and maintains substantially uniform pressure against the membrane and is sufficiently flexible so as to bend in all directions and to provide ready circulation of the electrolyte to and from the membrane surface.

19. The process of claim 17 wherein said mat is compressed to about 80 to 30 percent of its original uncompressed thickness under a compression pressure of between 50 and 2000 grams per square centimeter of projected area and the ratio between voids volume and apparent volume of the compressed mat is at least 75%.

20. The process of claim 18 wherein said mat is compressed to about 80 to 30 percent of its original uncompressed thickness under a compression pressure of between 50 and 2000 grams per square centimeter of projected area and the ratio between voids volume and apparent volume of the compressed mat is at least 75%.

* * * * *